US011239029B2

(12) United States Patent
Ochiai

(10) Patent No.: US 11,239,029 B2
(45) Date of Patent: Feb. 1, 2022

(54) WINDING APPARATUS AND WINDING METHOD USING SAME

(71) Applicant: NITTOKU Co., Ltd., Saitama (JP)

(72) Inventor: Yohei Ochiai, Nagasaki (JP)

(73) Assignee: NITTOKU CO., LTD., Saitama (JP)

( * ) Notice: Subject to any disclaimer, the term of this patent is extended or adjusted under 35 U.S.C. 154(b) by 189 days.

(21) Appl. No.: 16/646,000

(22) PCT Filed: May 10, 2019

(86) PCT No.: PCT/JP2019/018807

§ 371 (c)(1),
(2) Date: Mar. 10, 2020

(87) PCT Pub. No.: WO2020/003766

PCT Pub. Date: Jan. 2, 2020

(65) Prior Publication Data

US 2020/0211768 A1 Jul. 2, 2020

(30) Foreign Application Priority Data

Jun. 25, 2018 (JP) ..... JP2018-119519

(51) Int. Cl.

| | |
|---|---|
| ***H01F 41/00*** | (2006.01) |
| ***H01F 41/088*** | (2016.01) |
| ***H01F 41/094*** | (2016.01) |
| ***H01F 41/096*** | (2016.01) |

(52) U.S. Cl.

CPC ..... *H01F 41/088* (2016.01); *H01F 41/094* (2016.01); *H01F 41/096* (2016.01)

(58) Field of Classification Search

CPC .... H01F 41/088; H01F 41/064; H01F 41/094; H01F 41/096; H01F 41/098

See application file for complete search history.

(56) References Cited

U.S. PATENT DOCUMENTS

| | | | | |
|---|---|---|---|---|
| 4,262,853 | A * | 4/1981 | Dammar | H02K 15/09 242/433.3 |
| 5,615,183 | A | 3/1997 | Ishii | |
| 5,794,884 | A * | 8/1998 | Dolgas | H02K 1/12 242/433.3 |
| 6,419,181 | B1 * | 7/2002 | Stratico | H02K 15/095 242/433.3 |
| 2015/0183614 | A1 * | 7/2015 | Muto | H01F 41/073 242/530 |

FOREIGN PATENT DOCUMENTS

| | | | |
|---|---|---|---|
| CN | 101454850 | A | 6/2009 |
| CN | 104538128 | A | 4/2015 |
| EP | 2031610 | A1 | 3/2009 |
| JP | H10-154626 | A | 6/1998 |
| JP | 2004186414 | A | 7/2004 |

* cited by examiner

*Primary Examiner* — Emmanuel M Marcelo
(74) *Attorney, Agent, or Firm* — Rabin & Berdo, P.C.

(57) ABSTRACT

A winding apparatus, includes a winding core, a wire rod being wound on the winding core; a pair of flyers arranged across the winding core in an axial direction; flyer rotation means for rotating either one or both of the pair of flyers; wire storage tools respectively detachably provided on the pair of flyers, the wire rod to be wound on the winding core being stored on the wire storage tools; and tension devices respectively provided on the pair of flyers, the tension devices applying a tension to the wire rod fed from the wire storage tools and introduced to the winding core.

5 Claims, 13 Drawing Sheets

WINDING APPARATUS AND WINDING METHOD USING SAME

TECHNICAL FIELD

The present invention relates to a winding apparatus for winding a coil such that both a winding start end and a winding finish end of the coil are located on an outermost peripheral layer of the coil and a winding method using the same.

BACKGROUND ART

A so-called alpha-winding (or also referred to as "outer-outer winding") coil in which a wire rod is tightly wound not to form a useless clearance between winding layers and a winding start end and a winding finish end of the wire rod are disposed on the same winding layer is known as a coil coping with the miniaturization of a motor.

A two-row spiral coil including first and second coils formed by spirally winding a wire rod and an inner crossover connecting inner peripheral end parts of these first and second coils is known as this alpha-winding coil. An apparatus provided with first and second wheels which rotate around a winding core in directions opposite to each other while being separated by a clearance corresponding to twice the thickness of the wire rod, a wire rod supply unit for feeding the wire rod toward a guide groove or hole of the first wheel, and a wire storage unit for storing the wire rod in a wound state and feeding the wire rod toward a guide groove or hole of the second wheel has been proposed as a manufacturing apparatus for such a two-row spiral coil (see, paragraphs [0010], [0011] and [0019] of JPH10-154626A).

In this manufacturing apparatus, the wire rod supplied from the wire rod supply unit is stored in the wire storage unit as a preliminary stage for winding and, thereafter, the first and second wheels are rotated in the mutually opposite directions with an arbitrary position of the wire rod between the wire rod supply unit and the wire storage unit as a winding start. In this way, sections of the wire rod extending toward both sides from the winding start position are simultaneously wound on a winding core in the mutual opposite directions, whereby coil parts in two layers in an axial direction of the winding core can be formed on the outer periphery of the winding core.

As just described, in this manufacturing apparatus, a two-row spiral coil in which a winding start end and a winding finish end of a wire rod are pulled out from the same winding layer on the outermost periphery can be relatively easily manufactured by leading out the wire rod from the outer periphery of each coil part.

SUMMARY OF INVENTION

However, in the coil manufacturing apparatus of JPH10-154626A, the first and second wheels are rotated in the mutually opposite directions after the wire rod supplied from the wire rod supply unit is stored in the wire storage unit, whereby the wire rod fed from the both wheels is wound on the winding core. Thus, the size of the obtained coil is limited by a length of the wire rod suppliable from the wire storage unit and the manufacturing of a relatively large coil using a relatively long wire rod is difficult.

To obtain a relatively large coil, it is considered to store a relatively long wire rod in the wire storage unit. However, if the relatively long wire rod is stored in the wire storage unit, more time is spent for a wire storing step performed before actual winding and it becomes difficult to quickly manufacture a coil.

Therefore, the problem is that a coil manufacturable in the coil manufacturing apparatus of JPH10-154626A is limited to a relatively small-size coil such as a two-row spiral coil in which a first coil and a second coil, each having the same number of turns, are coupled by an inner crossover.

The present invention aims to provide a winding apparatus capable of quickly manufacturing a large-size coil having a relatively large number of turns and a winding method using the same.

According to one aspect of the present invention, a winding apparatus, includes a winding core, a wire rod being wound on the winding core; a pair of flyers arranged across the winding core in an axial direction;

flyer rotation means for rotating either one or both of the pair of flyers; wire storage tools respectively detachably provided on the pair of flyers, the wire rod to be wound on the winding core being stored on the wire storage tools; and tension devices respectively provided on the pair of flyers, the tension devices applying a tension to the wire rod fed from the wire storage tools and introduced to the winding core.

According to another aspect of the present invention, a winding method using the winding apparatus, includes a wire storing step of winding a wire rod having a necessary length on a pair of the wire storage tools from both sides; a wire storage tool mounting step of mounting the pair of wire storage tools having the wire rod wound thereon from both ends on the pair of flyers of the winding apparatus; and a winding step of winding the wire rod fed from the wire storage tools on the winding core by rotating either one or both of the pair of flyers about an axis of the winding core as a center of rotation and forming a coil around the winding core, both a winding start end and a winding finish end being led out from an outermost peripheral layer.

DESCRIPTION OF EMBODIMENT

Hereinafter, an embodiment of the present invention is described on the basis of the drawings.

Figure 1:
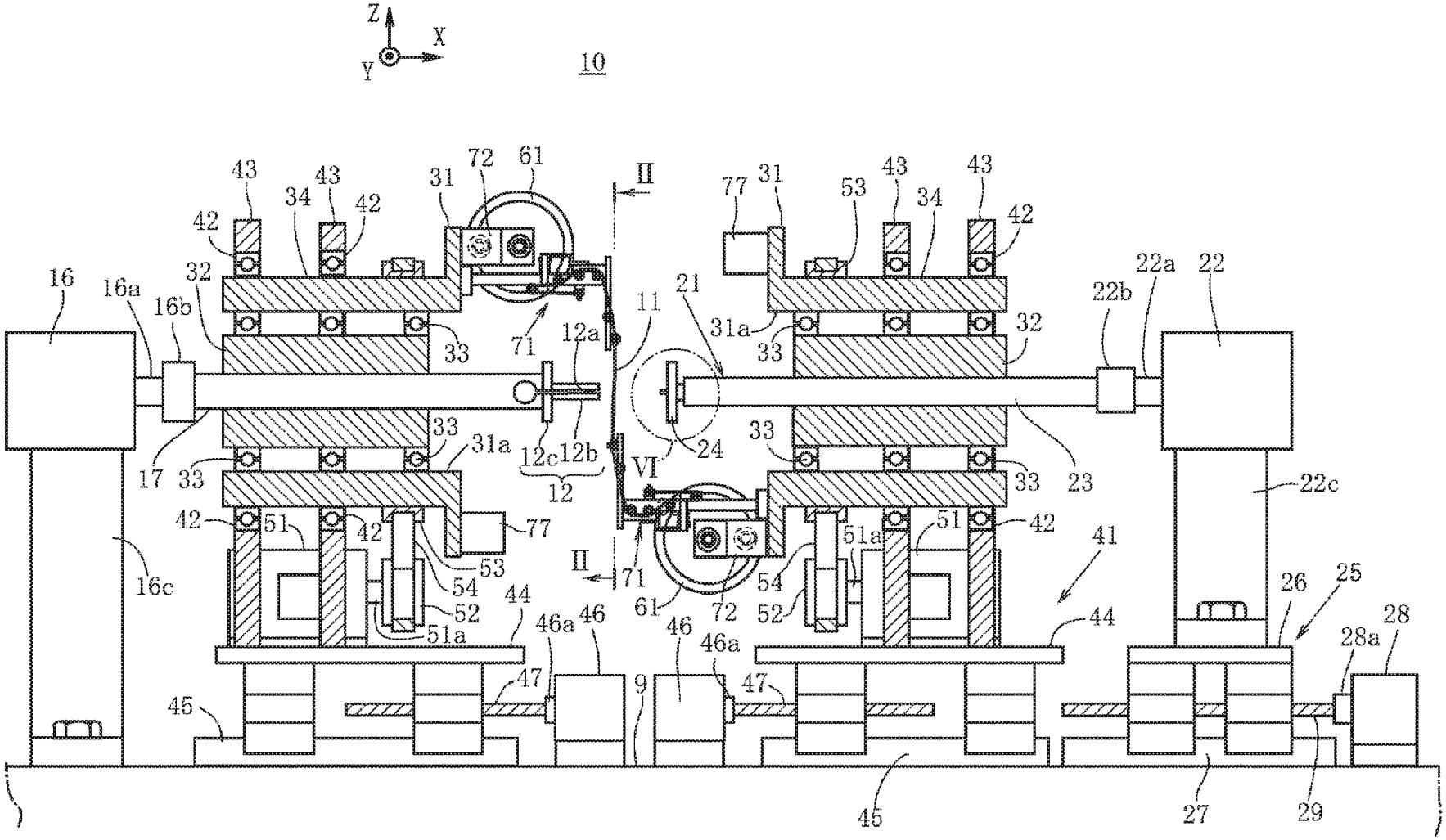
FIG. 1 is a front view showing a winding apparatus according to an embodiment of the present invention.

FIG. 1 shows a winding apparatus 10 according to the embodiment of the present invention. Here, three axes X, Y and Z orthogonal to each other are set. The configuration of the winding apparatus 10 is described, assuming that the X axis extends substantially in a horizontal front-rear direction, the Y axis extends substantially in a horizontal lateral direction and the Z axis extends substantially in a vertical direction.

As shown in FIG. 1, the winding apparatus 10 includes a winding core 12 on which a wire rod 11 is wound, and a winding core servo motor 16 serving as winding core rotation means for rotating the winding core 12 about an axis thereof. The winding core 12 includes a cylindrical body portion 12*b* having a circular cross-section and a flange 12*c* provided on a base end side of the body portion 12*b*. The flange 12*c* has a larger diameter than the body portion 12*b*. An extension shaft 17 is coaxially provided on a rotary shaft 16*a* of the winding core servo motor 16 via a joint 16*b*. A base end of the winding core 12 on the side of the flange 12*c* is coaxially provided on the tip of the extension shaft 17.

The winding core servo motor 16 is mounted on a base 9 via a pedestal 16*c* with the rotary shaft 16*a* thereof oriented in an X-axis direction. Thus, the winding core 12 having the base end mounted on the rotary shaft 16*a* of the winding core servo motor 16 via the extension shaft 17 is rotatable with the X axis as a rotation axis if the winding core servo motor 16 is driven.

This winding apparatus 10 includes a supporting tool 21 for supporting a tip side of the winding core 12 having the base end side supported on the extension shaft 17. This supporting tool 21 includes a support servo motor 22, a pressing shaft 23 coaxially provided on a rotary shaft 22*a* of the support servo motor 22 via a joint 22*b*, and a moving mechanism 25 for moving the pressing shaft 23 in the X-axis direction together with the support servo motor 22.

The moving mechanism 25 in this embodiment includes a guide rail 27 arranged in parallel to the rotation axis (X axis) of the winding core 12 on the base 9, a moving body 26 to be guided by the guide rail 27, a movement motor 28 provided on the base 9 and a ball screw 29 coupled to a rotary shaft 28*a* of the movement motor 28. The movement motor 28 is provided such that the rotary shaft 28*a* is parallel to the guide rail 27. The ball screw 29 extends in a rotation axis direction (X-axis direction) of the winding core 12 and is threadably engaged with the moving body 26. The support servo motor 22 is mounted on the moving body 26 via a pedestal 22*c* such that the pressing shaft 23 is oriented in the X-axis direction and the tip of the pressing shaft 23 faces the tip of the winding core 12.

In this way, in this moving mechanism 25, the ball screw 29 rotates and the moving body 26 threadably engaged with the ball screw 29 is guided by the guide rail 27 and moves if the movement motor 28 is driven. Then, the support servo motor 22 mounted on the moving body 26 also moves in the rotation axis direction (X-axis direction) of the winding core 12 together with the moving body 26.

Figure 3:
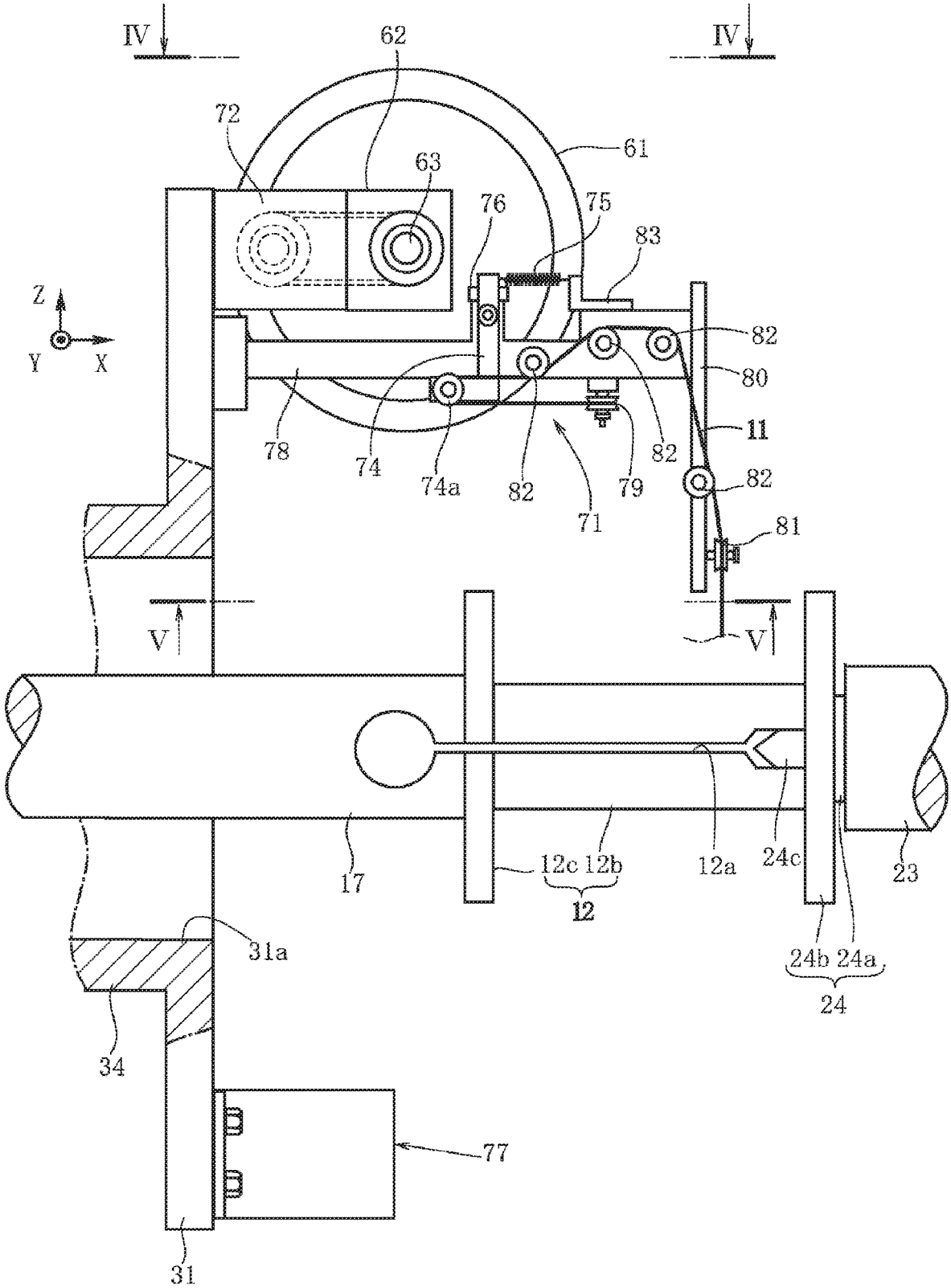
FIG. 3 is a view of a flyer viewed from a direction III of FIG. 2.

If the support servo motor 22 is moved in the rotation axis direction of the winding core 12 by driving the movement motor 28, the pressing shaft 23 provided on the support servo motor 22 coaxially with the winding core 12 approaches the winding core 12. A pressing tool 24 provided on the tip of the pressing shaft 23 is configured to be able to contact the tip of the winding core 12 (FIG. 3).

Figure 6:
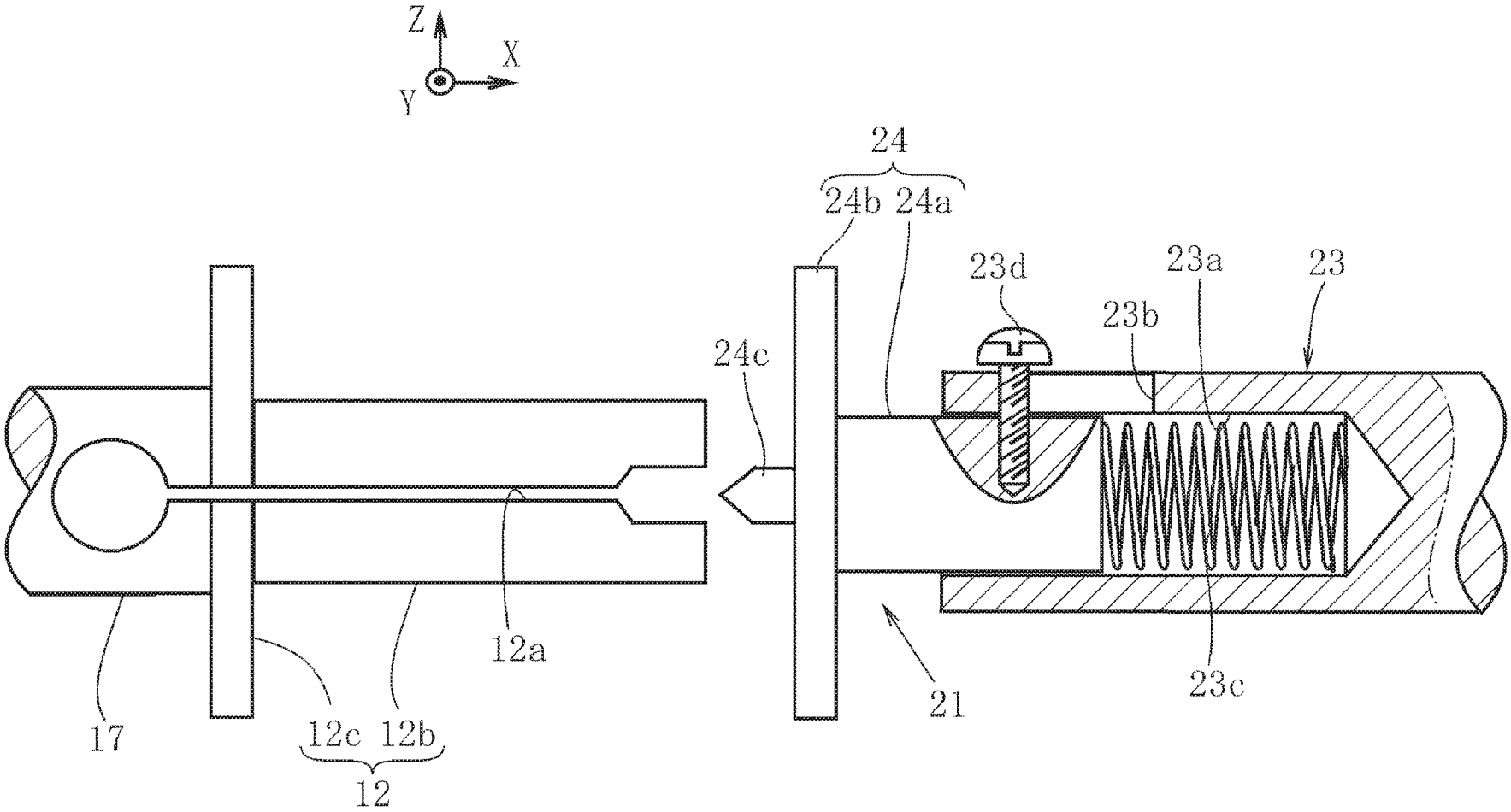
FIG. 6 is an enlarged sectional view of a part VI of FIG. 1 showing a structure on a tip side of a supporting tool.

As shown in detail in FIG. 6, a hole 23*a* is formed in an axial direction from a leading edge on the tip of the pressing shaft 23. The pressing tool 24 includes an inserting portion 24*a* to be inserted into the hole 23*a*, a pressing portion 24*b* formed to have a larger diameter than the pressing shaft 23 and configured to actually contact the tip of the winding core 12. A long hole 23*b* extending in the axial direction in a peripheral wall is formed on the tip of the pressing shaft 23. The long hole 23*b* is formed to penetrate from the outer periphery of the pressing shaft 23 to the inner periphery of the hole 23*a*.

A coil spring 23*c* is inserted into the hole 23*a*. The inserting portion 24*a* is further inserted into the hole 23*a* to compress the coil spring 23*c*. A male screw 23*d* is inserted into the long hole 23*b* and screwed into the inserting portion 24*a* in the pressing tool 24. In this way, the pressing tool 24 is provided movably in the axial direction in a moving range of the male screw 23*d* in the long hole 23*b* on the tip of the pressing shaft 23. The coil spring 23*c* biases the pressing tool 24 in a direction to project from the hole 23*a* by an expansion force. The male screw 23*d* comes into contact with a hole edge of the long hole 23*b* to prevent the detachment of the inserting portion 24*a* in the pressing tool 24 from the hole 23*a*.

The winding core 12 in this embodiment is formed with a slit 12*a* continuously extending in the axial direction from the tip of the winding core 12 up to the extension shaft 17 through the winding core 12. The pressing portion 24*b* is formed with a ridge 24*c* for prohibiting a width of the slit 12*a* from being narrowed by entering the slit 12*a*. If the pressing shaft 23 approaches the winding core 12 and the pressing tool 24 provided on the tip of the pressing shaft 23 contacts the tip of the winding core 12, the ridge 24*c* on the pressing tool 24 enters the slit 12*a* as shown in FIG. 3 to prohibit the width of the slit 12*a* from being narrowed. The pressing portion 24*b* comes into contact with the tip of the winding core 12 to limit a possible winding width of the wire rod 11 on the winding core 12.

In this way, the pressing tool 24 supports the tip of the winding core 12. The support servo motor 22 (FIG. 1) rotates the pressing tool 24 in synchronization with the rotation of the winding core 12 so that a relative positional relationship of the winding core 12 and the pressing tool 24 does not change.

On the other hand, referring back to FIG. 1, if the movement motor 28 rotates the ball screw 29 in an opposite direction, the moving body 26 is separated from the winding core 12 to form a clearance between the winding core 12 and the pressing tool 24. If the ridge 24*c* on the pressing tool 24 is separated from the slit 12*a* as shown in FIG. 6, a reduction in the outer diameter of the winding core 12 by the narrowing of the width of the slit 12*a* is allowed.

Although not shown, if the wire rod 11 is wound on the winding core 12, the wire rod 11 forms a coil. If the clearance is formed between the winding core 12 and the pressing tool 24, the coil formed of the wire rod 11 wound on the winding core 12 can be pulled out from the winding core 12 having the reduced outer diameter via the clearance. Thus, the moving mechanism 25 is configured such that a moving distance of the moving body 26 is longer than the winding width of the winding core 12, i.e. a length of the body portion 12*b* of the winding core 12.

As shown in FIG. 1, the winding apparatus 10 according to the present embodiment includes a pair of flyers 31, 31 arranged across the winding core 12 in the axial direction. This is specifically described below. A sliding tube 32 is fitted on the extension shaft 17 having the base end of the winding core 12 mounted on the tip movably in a longitudinal direction with respect to the extension shaft 17. Similarly, a sliding tube 32 is fitted to the pressing shaft 23 for supporting the tip of the winding core 12 movably in the longitudinal direction with respect to the pressing shaft 23. A rotary tube 34 is fitted on the sliding tube 32 of each of the extension shaft 17 and the pressing shaft 23 via bearings 33. Each flyer 31 is mounted on an end edge of each rotary tube 34 on the side of the winding core 12.

As just described, the pair of flyers 31, 31 are mounted on the rotary tubes 34 fitted on the extension shaft 17 and the pressing shaft 23 via the sliding tubes 32. Each of the pair of flyers 31, 31 is rotatable about the rotation axis (X axis) of the winding core 12 and movable in the rotation axis direction.

The winding apparatus 10 of the present embodiment including such a pair of flyers 31, 31 includes a pair of rotation servo motors 51 constituting flyer rotation means for rotating either one or both of the pair of flyers 31, 31 in synchronization or separately about an axis of the winding core 12 as a center of rotation, and a traverse mechanism 41 for moving either one or both of the pair of flyers 31, 31 in the axial direction with respect to the winding core 12.

The traverse mechanism 41 according to the present embodiment is configured to make the pair of flyers 31, 31 separately movable. The traverse mechanism 41 includes a plurality of supporting walls 43 pivotally supporting the pair of rotary tubes 34 via bearings 42, a pair of moving tables 44 on which the plurality of supporting walls 43 stand, a plurality of guide rails 45 arranged in parallel to the rotation axis of the winding core 12 on the base 9 and configured to guide the moving tables 44, a pair of traverse motors 46 provided on the base 9 and a pair of ball screws 47 coupled to rotary shafts 46*a* of the traverse motors 46. The traverse motor 46 is provided such that the rotary shaft 46*a* thereof is parallel to the guide rail 45. The ball screw 47 extends in the rotation axis direction (X-axis direction) of the winding core 12 and is threadably engaged with the moving table 44.

In this traverse mechanism 41, if the traverse motor 46 is driven, the ball screw 47 rotates and the moving table 44 threadably engaged with the ball screw 47 is guided by the guide rail 45 and moves. Then, the supporting walls 43 standing on the moving table 44 also move in the same direction, and the rotary tube 34 pivotally supported on the supporting walls 43 moves in the axial direction (X-axis direction) of the winding core 12 together with the flyer 31. As just described, since the traverse motor 46 and the like are provided for each of the pair of flyers 31, 31 in the traverse mechanism 41 according to the present embodiment, the pair of flyers 31, 31 can be separately moved. It should be noted that the traverse mechanism 41 can also simultaneously move the pair of flyers 31, 31.

As described above, the winding apparatus 10 includes the pair of rotation servo motors 51 capable of separately rotating the pair of flyers 31, 31 as flyer rotation means for rotating the pair of flyers 31, 31. Each of the pair of rotation servo motors 51 is adjacent to each rotary tube 34 and provided on each moving table 44. A drive pulley 52 is provided on a rotary shaft 51*a* of the rotation servo motor 51, and a driven pulley 53 is provided at a position of the rotary tube 34 corresponding to the drive pulley 52. A belt 54 is mounted between the drive pulley 52 on the rotation servo motor 51 and the pulley 53 on the rotary tube 34.

If the rotation servo motor 51 serving as the flyer rotation means is driven and the rotary shaft 51*a* thereof rotates together with the drive pulley 52, the rotation is transmitted to the rotary tube 34 via the belt 54 and the driven pulley 53 to rotate the rotary tube 34. If the rotary tube 34 rotates, the flayer 31 provided on the rotary tube 34 rotates with the winding core 12 as a center of rotation. As just described, since the rotation servo motor 51 is provided for each of the pair of flyers 31, 31 in the winding apparatus 10 according to the present embodiment, the pair of flyers 31, 31 can be separately rotated. It should be noted that the pair of rotation servo motors 51 can also rotate the plurality of flyers 31, 31 in synchronization.

Figure 2:
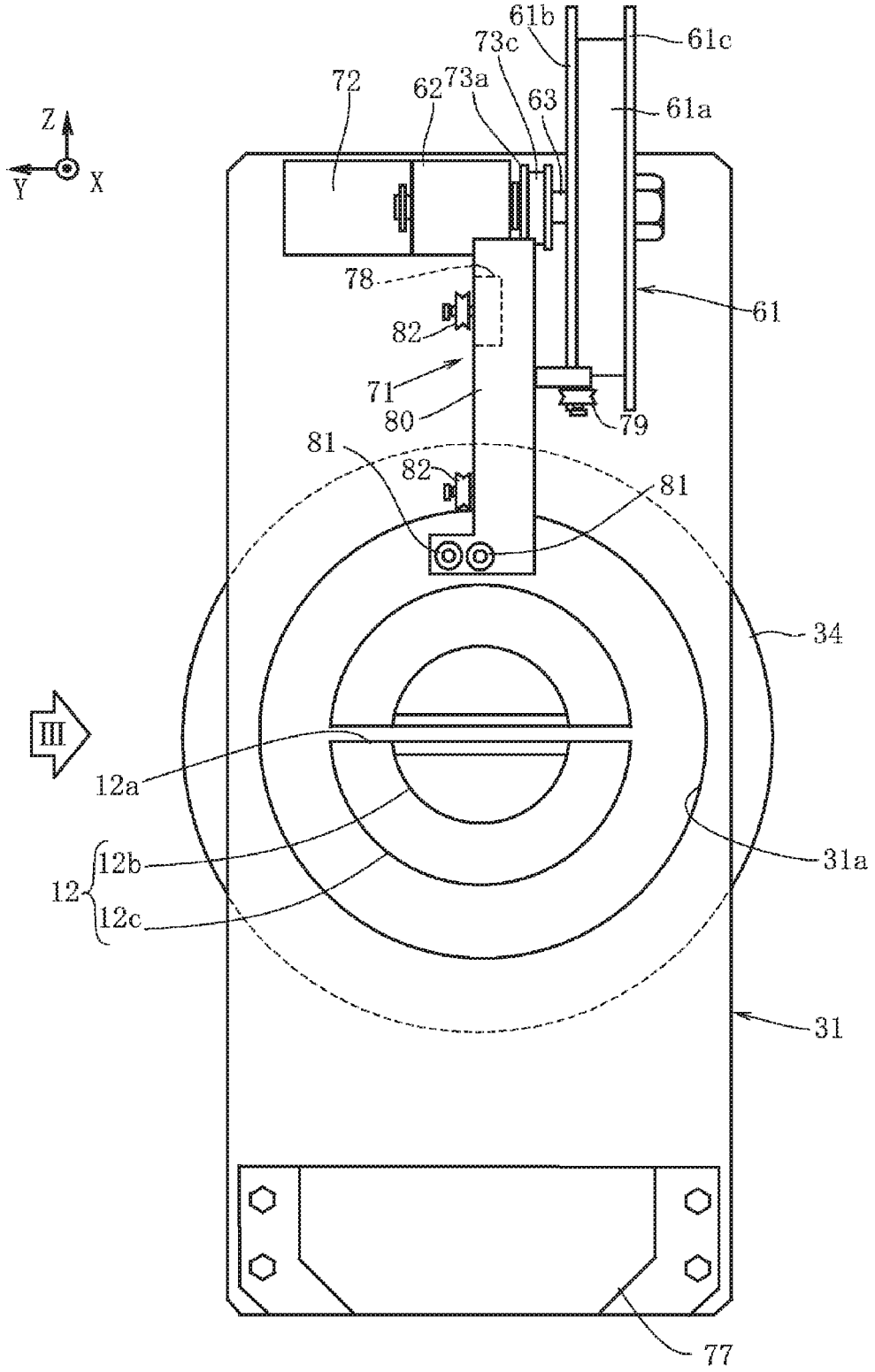
FIG. 2 is a sectional view along line II-II of FIG. 1.

As shown in detail in FIGS. 1 and 2, the pair of flyers 31, 31 are provided on sides of the pair of rotary tubes 34 facing each other. The flyers 31, 31 respectively provided on the pair of rotary tubes 34 are rectangular plate materials extending along planes orthogonal to the rotation axis of the winding core 12, and formed in the centers thereof with round holes 31*a* into which the extension shaft 17 or the pressing shaft 23 is insertable.

A wire storage tool 61 for storing the wire rod 11 to be wound on the winding core 12 and a tension device 71 for applying a tension to the wire rod 11 fed from the wire storage tool 61 and introduced to the winding core 12 are respectively provided on one longitudinal end part of each of the pair of rectangular flyers 31, 31. Further, a control unit 77 having a central processing unit built in a hard case is provided as feeding speed control means to be described later on the other longitudinal end part of each of the pair of rectangular flyers 31, 31.

The wire storage tool 61 provided on one of the pair of flyers 31, 31 and the wire storage tool 61 provided on the other have the same structure. Further, the tension device 71 provided on one of the pair of flyers 31, 31 and the tension device 71 provided on the other have the same structure. Thus, the wire storage tool 61 and the tension device 71 provided on the flyer 31 having the extension shaft 17 inserted into the round hole 31*a* are described as representatives, and the description of the wire storage tool 61 and the tension device 71 provided on the flyer 31 having the pressing shaft 23 inserted into the round hole 31*a* is omitted.

Figure 7:
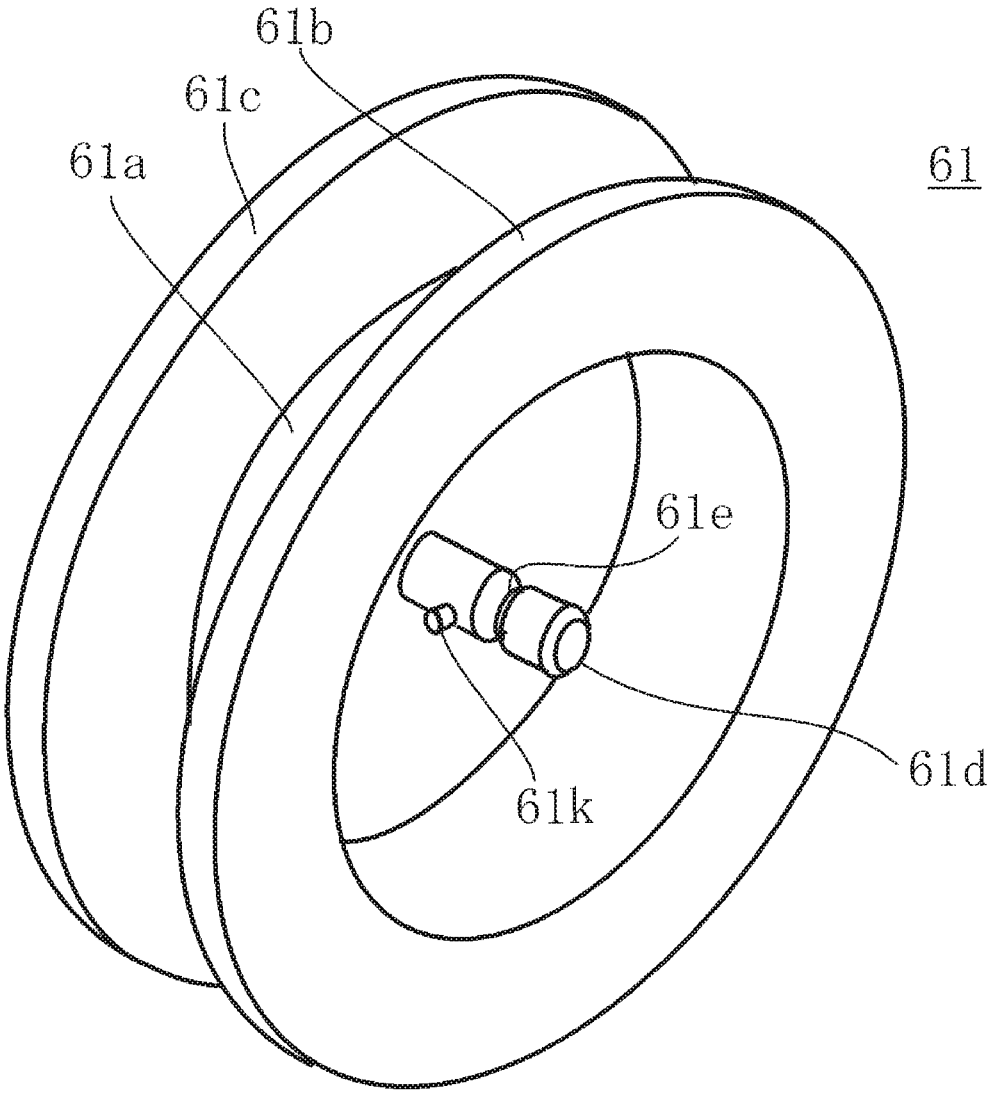
FIG. 7 is an enlarged perspective view of a wire storage tool.
Figure 8:
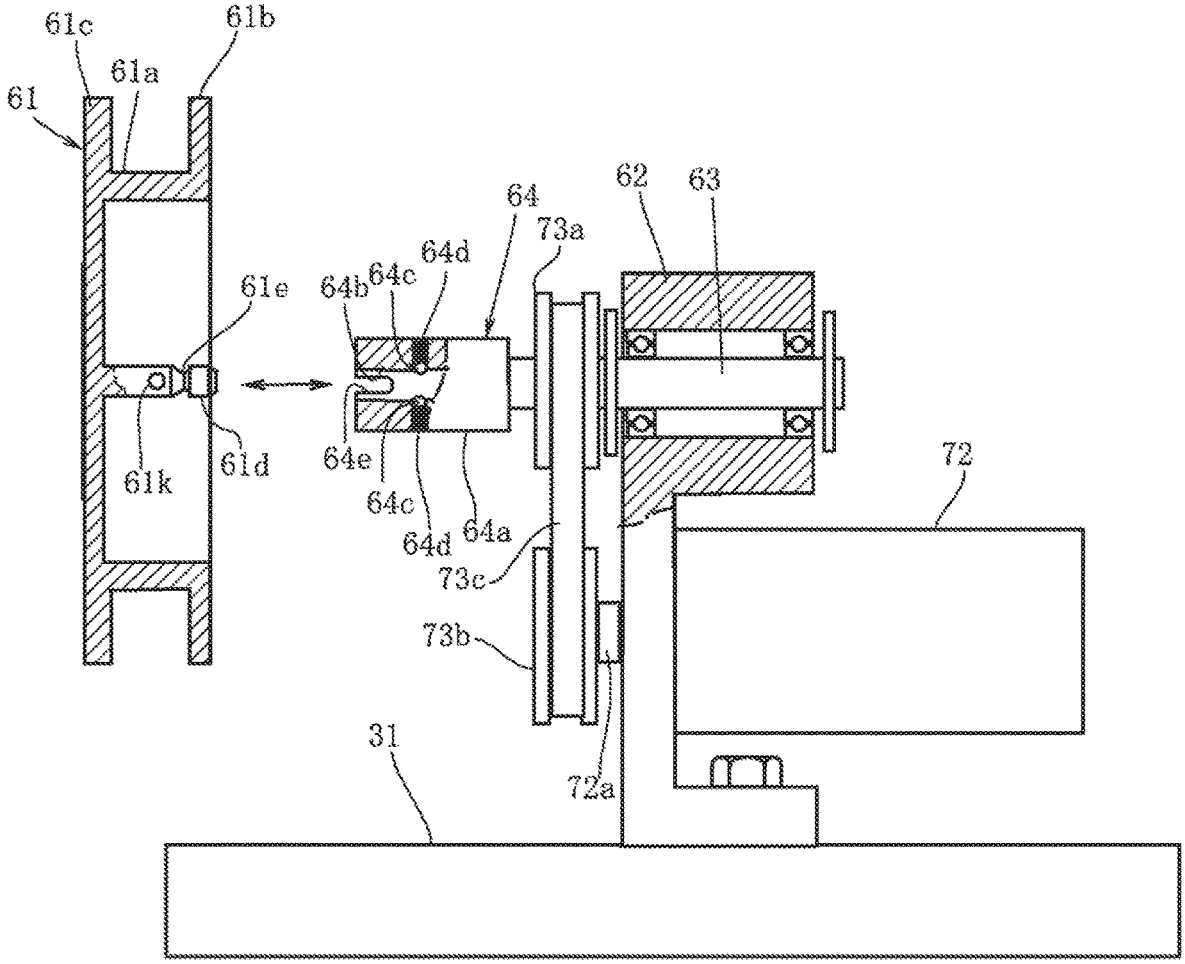
FIG. 8 is an enlarged sectional view of a part VIII of FIG. 4 showing a mechanism for detachably mounting the wire storage tool on the flyer.

As shown in detail in FIGS. 7 and 8, the wire storage tool 61 is a spool made of plastic and including a winding member 61*a* in the form of a bottomed tube around which the wire rod 11 is actually wound, and a pair of flange portions 61*b*, 61*c* formed at a distance from each other in the axial direction around the winding member 61*a*. The wire storage tool 61 having a relatively large diameter is used so as to be able to wind the relatively long wire rod 11. A coupling shaft 61*d* is formed to project on a center axis in the wire storage tool 61. An annular groove 61*e* is circumferentially formed on the tip of this coupling shaft 61*d*.

As shown in FIGS. 2,3 and 8, a pivot table 62 is provided in parallel to the winding core 12 on an outer peripheral part of the flyer 31, and a mounting shaft 63 extending in a rotation tangential direction of the flyer 31 is pivotally supported in the pivot table 62. A lock mechanism 64 (FIG. 8) is provided on a tip part of this mounting shaft 63.

As shown in detail in FIG. 8, the lock mechanism 64 in this embodiment includes a tubular body 64*a* having a coupling hole 64*b* into which the coupling shaft 61*d* in the wire storage tool 61 is insertable, a lock member 64*c* provided in the tubular body 64*a* and engaged with the annular groove 61*e* formed on the coupling shaft 61*d*, a spring 64*d* for pressing the lock member 64*c* against the annular groove 61*e*, and the like.

The tubular body 64*a* is coaxially provided on the tip of the mounting shaft 63. The tubular body 64*a* is formed with a slit 64*e* extending in the axial direction from an end part thereof. A projection 61*k* insertable into the slit 64*e* is formed on the coupling shaft 61*d*. Thus, if the coupling shaft 61*d* is inserted into the coupling hole 64*b* against a biasing force of the spring 64*d*, the lock member 64*c* is pressed against the annular groove 61*e* by the biasing force of the spring 64*d*, whereby the coupling shaft 61*d* is prevented from coming out from the coupling hole 64*b*.

Since the projection 61*k* enters the slit 64*e* with the coupling shaft 61*d* inserted in the coupling hole 64*b*, the wire storage tool 61 is unrotatably mounted on the mounting shaft 63.

As just described, the wire storage tool 61 is detachably mounted on the mounting shaft 63 via the lock mechanism 64. Further, the wire storage tool 61 rotates together with the mounting shaft 63 while being mounted on the mounting shaft 63, and is prohibited from rotating separately independently of the mounting shaft 63.

On the other hand, a feed motor 72 capable of controlling a rotation speed of the mounting shaft 63 is mounted on the pivot table 62 such that a rotary shaft 72*a* thereof is parallel to the mounting shaft 63. A driven pulley 73 is provided on the mounting shaft 63 having the lock mechanism 64 mounted thereon, and a drive pulley 73*b* is provided on the rotary shaft 72*a* of the feed motor 72. A belt 73*c* is mounted between the driven pulley 73*a* and the drive pulley 73*b*. If the rotary shaft 72*a* is rotated by the feed motor 72, the wire storage tool 61 also rotates together with the mounting shaft 63. By the rotation of the wire storage tool 61, the wire rod 11 is taken up or fed. If the rotation of the rotary shaft 72*a* of the feed motor 72 is stopped, the rotation of the wire storage tool 61 is also stopped and the take-up and the feed of the wire rod 11 are prohibited.

Figure 4:
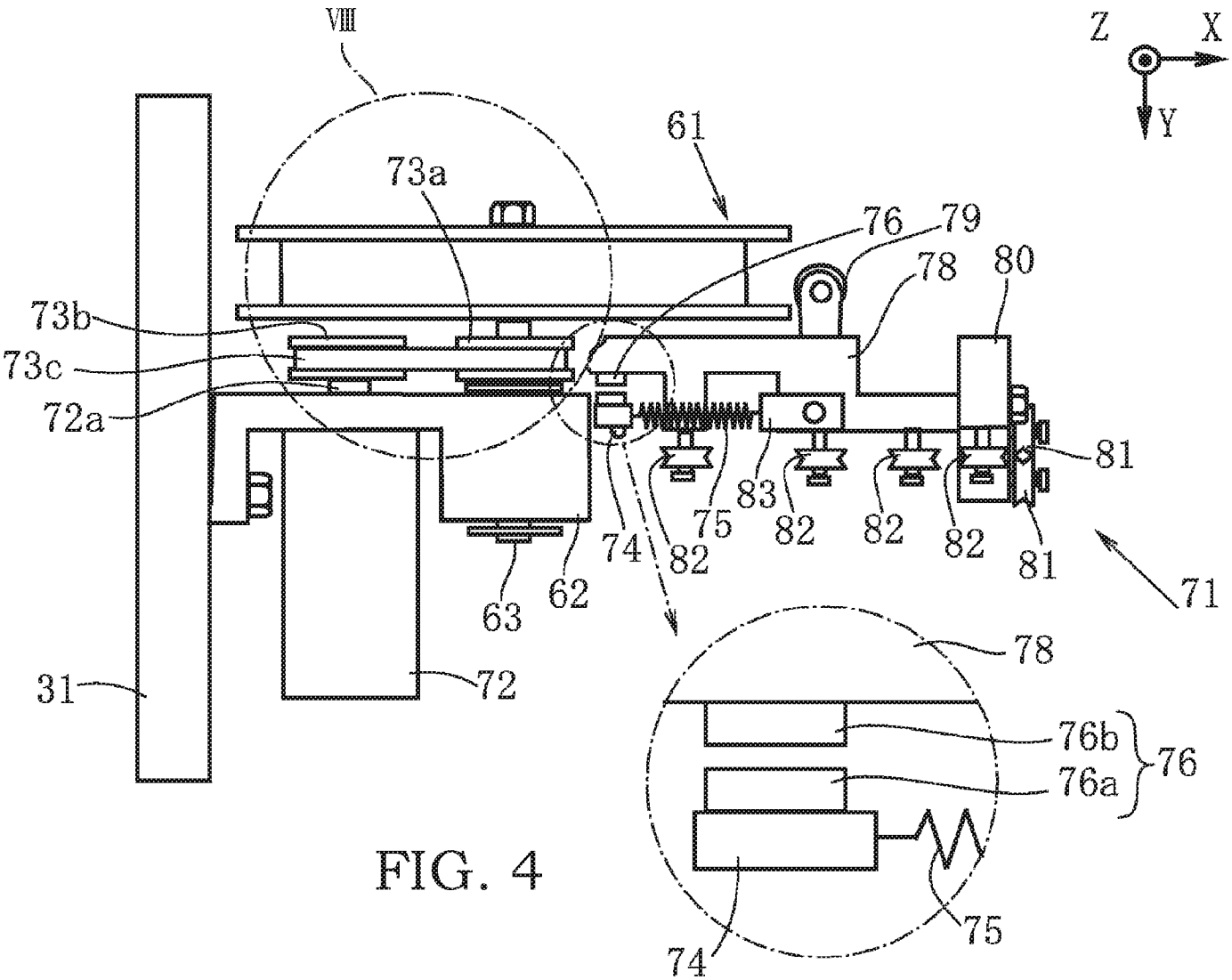
FIG. 4 is a sectional view along line IV-IV of FIG. 3.
Figure 5:
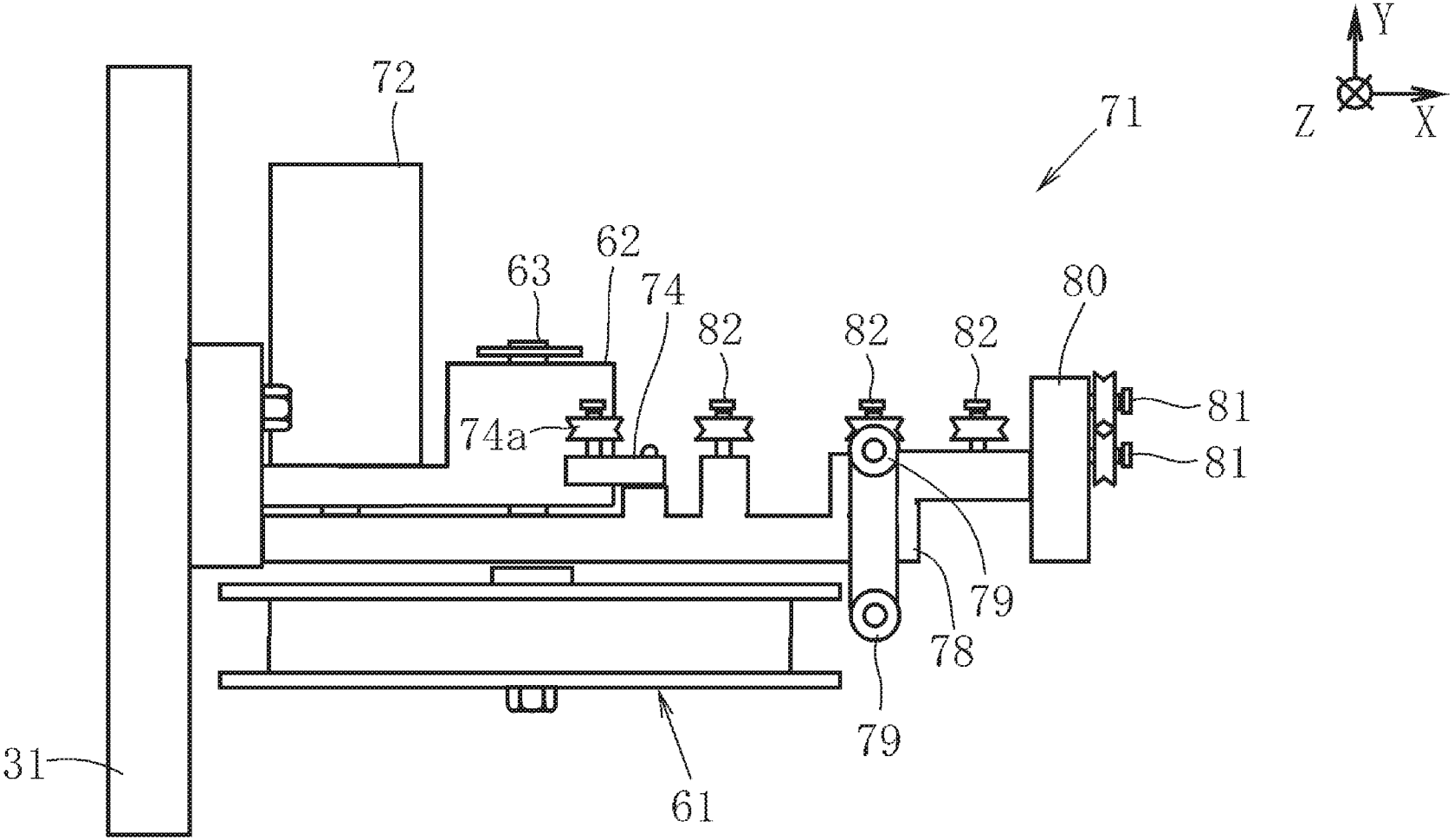
FIG. 5 is a sectional view along line V-V of FIG. 3.

The tension device 71 for applying a tension to the wire rod 11 fed from the wire storage tool 61 is described with reference to FIGS. 3 to 5. As shown in FIGS. 3 to 5, the tension device 71 includes the above feed motor 72, a tension bar 74 having a turning pulley 74*a* serving as a wire rod guide provided on a tip and having a base end pivotally supported, a coil spring 75, which is an elastic member for generating an elastic force corresponding to a rotation angle of the tension bar 74, a linear sensor 76, which is detection means for detecting the rotation angle of the tension bar 74, and the control unit 77 (FIG. 3), which is the feeding speed control means for controlling the feeding speed of the wire rod 11 such that the rotation angle detected by the linear sensor 76 becomes a predetermined angle.

A mounting table 78 is provided adjacent to the feed motor 72 on the outer peripheral part of the flyer 31 near the pivot table 62. The mounting table 78 stands on the outer peripheral part of the flyer 31 to be parallel to the pivot table 62. The base end of the tension bar 74 is pivotally supported on an intermediate part of the mounting table 78. The tension bar 74 is pivotally supported to cross the mounting table 78. The turning pulley 74*a* serving as the wire rod guide is pivotally supported on the tip of the tension bar 74.

A plurality of pulleys 79, on which the wire rod 11 unwound from the wire storage tool 61 is wound, are pivotally supported on a tip side of the mounting table 78 beyond the tension bar 74. The wire rod 11 is guided toward a base end side of the mounting table 78 by the plurality of pulleys 79, is wound to be folded at the turning pulley 74*a*, and moves toward the tip side of the mounting table 78 again from the turning pulley 74*a*.

An extension piece 80 extending toward the winding core 12 is mounted on the tip of the mounting table 78. A feeding pulley 81 for guiding the wire rod 11 to the winding core 12 is provided on an end part of this extension piece 80 on the side of the winding core 12. A plurality of guiding pulleys 82 for guiding the wire rod 11 folded by the turning pulley 74*a* to the feeding pulley 81 are pivotally supported on the mounting table 78 and the extension piece 80.

As shown in FIGS. 3 and 4, the coil spring 75 is an elastic member for biasing the turning pulley 74*a* toward the base end side of the mounting table 78. One end of the coil spring 75 is mounted on the base end side of the tension bar 74, and the other end thereof is mounted on the tip side of the mounting table 78 via a mounting member 83. The coil spring 75 is provided along the mounting table 78.

The fixed position of the other end of the coil spring 75 mounted on the mounting table 78 via the mounting member 83 can be changed. The coil spring 75 generates an elastic force corresponding to the rotation angle of the tension bar 74.

As shown in FIG. 4, the linear sensor 76, which is the detection means for detecting the rotation angle of the tension bar 74, includes a sensor rod 76*a* and a sensor head 76*b*. The sensor rod 76*a* is mounted on the tension bar 74 and moves as the tension bar 74 rotates. The sensor head 76*b* is provided on the mounting table 78 and configured to be able to output a voltage based on the position of the sensor rod 76*a*. The linear sensor 76 is connected to the control unit (feeding speed control means) 77 (FIG. 3) and a signal detected by the linear sensor 76 is output to the control unit (feeding speed control means) 77.

As shown in FIGS. 2 and 3, the control unit 77 keeping balance with the wire storage tool 61 and the tension device 71 is provided on an end part of the flyer 31 opposite to a side where the wire storage tool 61 and the tension device 71 are provided. The control unit 77 includes the hard case and the central processing unit built in the hard case. The central processing unit of the control unit 77 computes the rotation angle of the tension bar 74 on the basis of a detection signal of the linear sensor 76 and controls a rotation speed of the rotary shaft 72*a* of the feed motor 72 so that the computed angle becomes a predetermined angle. The central processing unit of the control unit 77 is configured to adjust the rotation speed of the wire storage tool 61 and match the feeding speed of the wire rod 11 unwound from the wire storage tool 61 and moving toward the winding core 12 with a winding speed of the wire rod 11 on the winding core 12 by controlling the rotation speed of the rotary shaft 72*a* of the feed motor 72. As just described, the control unit 77 functions as the feeding speed control means for controlling the feeding speed of the wire rod 11 fed from the wire storage tool 61 toward the winding core 12.

At this time, the coil spring 75 biases the turning pulley 74*a* serving as the wire rod guide in a separating direction from the tip side of the mounting table 78, from which the wire rod 11 is fed toward the winding core 12, and applies a predetermined tension to the wire rod 11 to stretch the wire rod 11 wound on the turning pulley 74*a*.

Specifically, the control unit 77 serving as the feeding speed control means is configured to control the rotation speed of the feed motor 72 so that the feeding speed (feeding amount) of the wire rod 11 unwound from the wire storage tool 61 serving as a supply source for the wire rod 11 and fed toward the winding core 12 and the winding speed (winding amount) of the wire rod 11 on the winding core 12 are balanced, and hold the tension bar 74 including the turning pulley 74*a* having the wire rod 11 wound thereon and biased by the coil spring 75 at a predetermined rotation angle.

Here, a spring force of the coil spring 75 acts on the wire rod 11 according to the rotation angle of the tension bar 74, and a predetermined tension based on this spring force is applied to the wire rod 11. Thus, if the winding speed (winding amount) of the wire rod 11 on the winding core 12 changes in a winding operation of winding the wire rod 11 on the winding core 12, the rotation angle of the tension bar 74 changes and the tension applied to the wire rod 11 varies.

If the tension varies, the rotation angle of the tension bar 74, on which the spring force of the coil spring 75 is acting, changes. This tension variation is absorbed by a change of the rotation angle of the tension bar 74 and the application of an excessive tension to the wire rod 11 is prevented.

If the tension applied to the wire rod 11 changes to rotate the tension bar 74, that rotation angle change is detected by the linear sensor 76 and fed back to the control unit (feeding speed control means) 77. The control unit (feeding speed control means) 77 having received such a feedback controls the rotation speed of the feed motor 72 so that the rotation angle of the tension bar 74 returns to the predetermined angle, and matches the feeding speed of the wire rod 11 unwound from the wire storage tool 61 and moving toward the winding core 12 with the winding speed on the winding core 12 by adjusting the rotation speed of the wire storage tool 61. In this way, the rotation angle of the tension bar 74 returns to the predetermined angle and the tension applied to the wire rod 11 is returned to a predetermined value.

Further, if it is desired to change the tension acting on the wire rod 11 from the tension bar 74, the mounted position of the mounting member 83 on the mounting table 78 is changed. Since this can change a length of the coil spring 75 when the tension bar 74 is set at the predetermined rotation angle and adjust the spring force exerted to the tension bar 74 from the coil spring 75, the tension acting on the wire rod 11 can be set at a desired one.

Next, a winding method of the wire rod 11 using the above winding apparatus 10 is described.

In the above winding apparatus 10, the wire storage tool 61 for storing the wire rod 11 to be wound on the winding core 12 is provided in each of the pair of flyers 31, 31. The winding method of the wire rod 11 using the winding apparatus 10 includes a wire storing step of winding the wire rod 11 having a necessary length on the pair of wire storage tools 61 from both sides and a winding step of winding the wire rod 11 fed from the wire storage tools 61 on the winding core 12 by rotating either one or both of the pair of flyers 31, 31 in synchronization or separately with the axis of the winding core 12 as a center of rotation and forming a coil, in which both a winding start end and a winding finish end are led out from an outermost peripheral layer, around the winding core 12.

In the above winding apparatus 10, the wire storage tool 61 is detachably mounted on each of the pair of flyers 31, 31. Thus, the above wire storing step can be also performed with the wire storage tools 61 detached from the pair of flyers 31, 31. In the case of performing the wire storing step using the wire storage tools 61 detached from the flyers 31, 31, a wire storage tool mounting step of mounting the pair of wire storage tools 61 having the wire rod 11 wound thereon from both ends on the pair of flyers 31 of the winding apparatus 10 is performed between the wire storing step and the winding step.

Each step of the winding method in the case of forming a so-called air-core coil by directly winding the wire rod 11 on the winding core 12 is described in detail below.

<Wire Storing Step>

In the wire storing step, the wire rod 11 having a necessary length is wound on the pair of wire storage tools 61 from both sides. Prior to an operation of winding the wire rod 11 on the wire storage tools 61, the pair of wire storage tools 61 and the wire rod 11 having the necessary length are prepared. The wire rod 11 having the necessary length is the wire rod 11 having a length necessary to form a single coil desired to be obtained. If the wire rod 11 is stored by being wound on a drum, the wire rod 11 having the necessary length is first unwound from the drum and wound on one wire storage tool 61.

Figure 9:
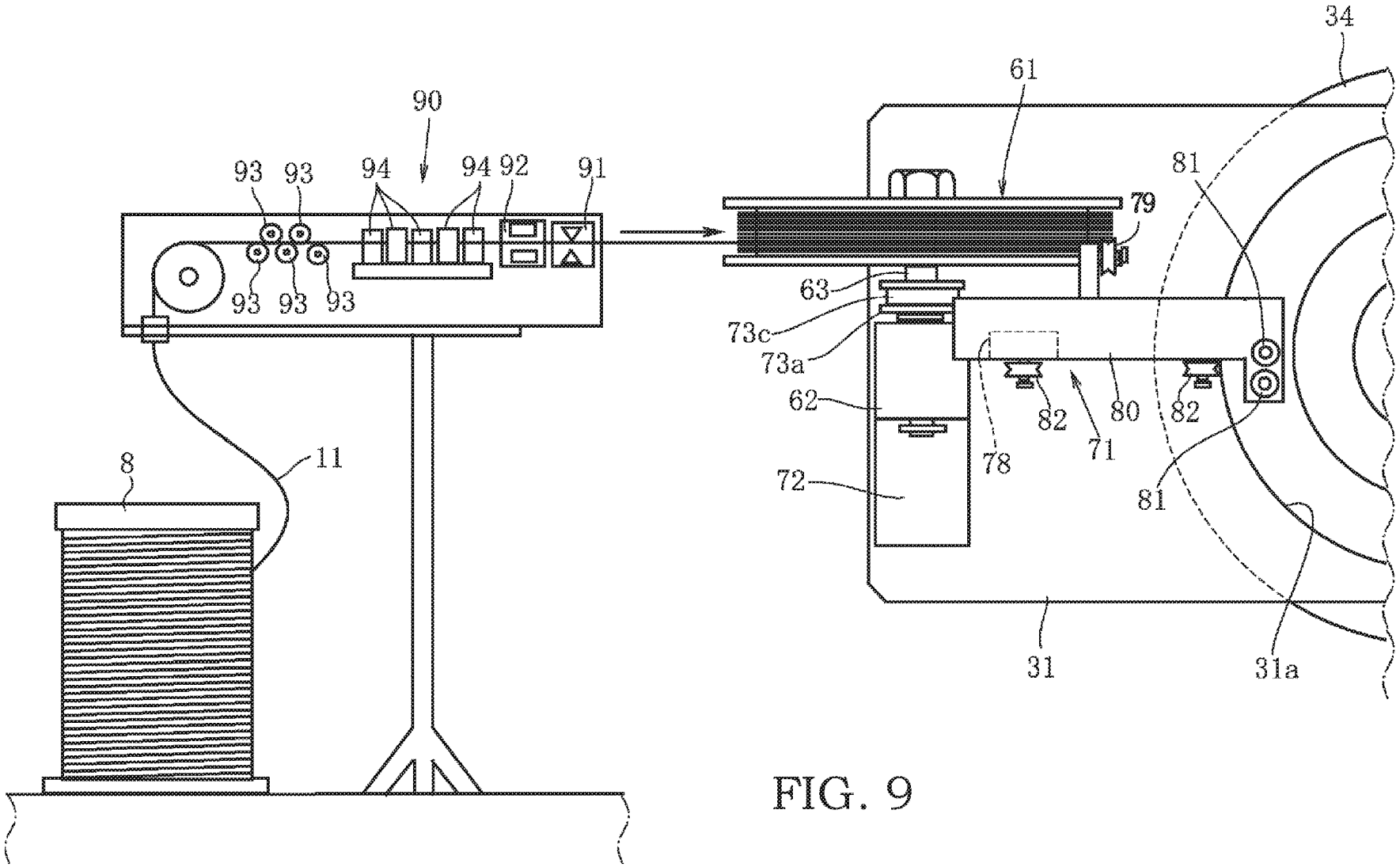
FIG. 9 is a diagram showing a state where a wire rod is wound on the wire storage tool mounted on the flyer.

If the wire storage tool 61 is mounted on the flyer 31 as shown in FIG. 9, the wire storage tool 61 is rotated by driving the feed motor 72 mounted on the flyer 31 after an end part of the wire rod 11 unwound from a drum 8 is fixed to the wire storage tool 61. In this way, the wire rod 11 unwound from the drum 8 is wound on one wire storage tool 61.

FIG. 9 shows a case where a calibration machine 90 for removing a bend of the wire rod 11 unwound from the drum 8 is used. This calibration machine 90 includes a cutting device 91 for cutting the wire rod 11, a wire rod gripping device 92 for gripping the wire rod 11, a plurality of vertical calibration rollers 93 for removing a vertical bend of the wire rod 11 and a plurality of lateral calibration rollers 94 for removing a lateral bend of the wire rod 11. The wire rod 11 is wound on the wire storage tool 61 after the wire bend is removed by passing between the plurality of rollers 93, 94 of the calibration machine 90.

After the wire rod 11 having the necessary length is wound on the one wire storage tool 61 provided on the one flyer 31, the wire rod 11 fed from the drum 8 is cut by the cutting device 91 with the wire rod 11 gripped by the wire gripping device 92. Then, as shown in FIG. 1, the cut end part is fixed to the other wire storage tool 61 provided on the other flyer 31. Thereafter, the feed motor 72 mounted on the flyer 31 provided with the other wire storage tool 61 is driven to rotate the other wire storage tool 61. At this time, the feed motor 72 mounted on the flyer 31 provided with the one wire storage tool 61 rotates the one wire storage tool 61 in an opposite direction, thereby unwinding and feeding the wire rod 11 of such a length as to be wound from the other wire storage tool 61 from the one wire storage tool 61.

As just described, a part (e.g. half) of the wire rod 11 wound on the one wire storage tool 61 is rewound on the other wire storage tool 61. In this way, the pair of wire storage tools 61 on which the wire rod 11 having the necessary length is wound from the both sides are obtained.

Figure 10A:
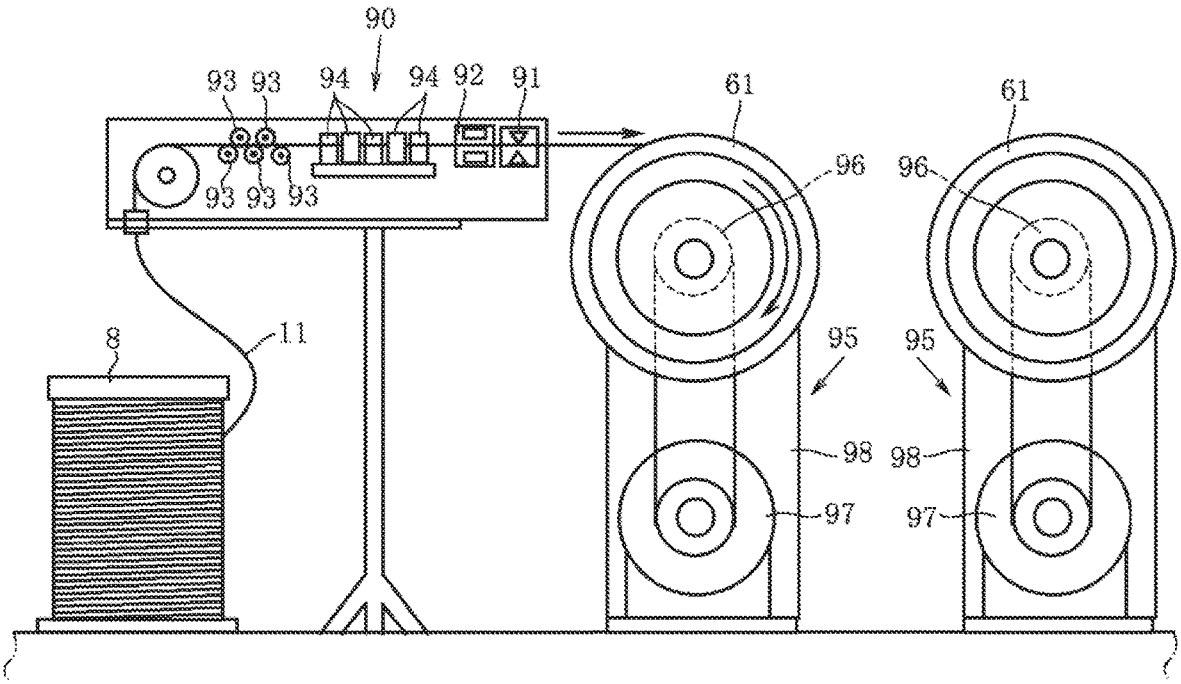
FIG. 10A is a diagram showing a state where the wire rod is wound on one of a pair of wire storage tools detached from the flyers.
Figure 10B:
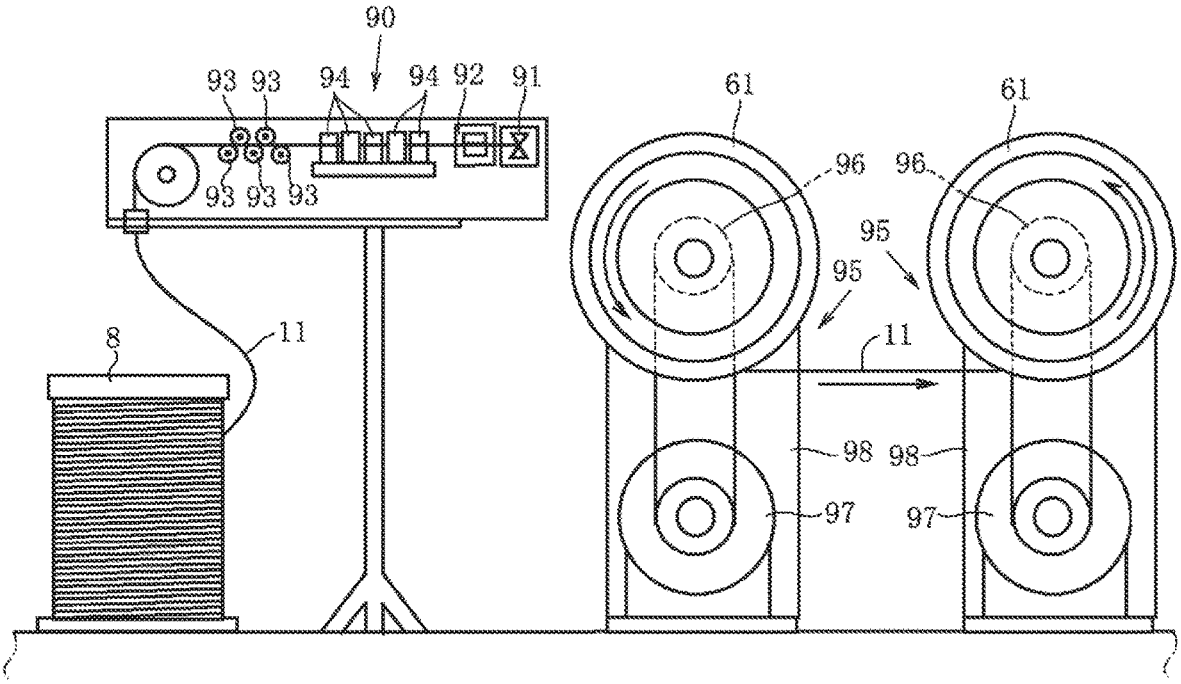
FIG. 10B is a diagram showing a state where the wire rod is wound on the other of the pair of wire storage tools detached from the flyers.

On the other hand, if the wire storage tools 61 are detached from the pair of flyers 31, 31, the wire rod 11 is wound on the wire storage tools 61 using spool rotating machines 95 provided separately from the winding apparatus 10 as shown in FIGS. 10A and 10B. The shown spool rotating machine 95 is such that a rotating body 96, on which the wire storage tool 61 is mounted, and a motor 97 for rotating the rotating body 96 are provided on a base plate 98. As shown in FIG. 10A, the wire rod 11 unwound from the drum 8 is wound on the rotating wire storage tool 61 by driving the motor 97 after the wire storage tool 61 is mounted on the rotating body 96 and an end part of the wire rod 11 unwound from the drum 8 is fixed to the wire storage tool 61.

Two spool rotating machines 95 are adjacently provided, one wire storage tool 61 is mounted on the rotating body 96 of one spool rotating machine 95 and the other wire storage tool 61 is mounted on the rotating body 96 of the other spool rotating machine 95. After the wire rod 11 having the necessary length is wound on the one wire storage tool 61, the wire rod 11 fed from the drum 8 is cut by the cutting device 91 with the wire rod 11 gripped by the wire rod gripping device 92 of the calibration machine 90.

Then, as shown in FIG. 10B, the motor 97 of the spool rotating machine 95 provided with the other wire storage tool 61 is driven to rotate the other wire storage tool 61 after the cut end part of the wire rod 11 is fixed to the other wire storage tool 61 on the other spool rotating machine 95. At this time, the motor 97 of the spool rotating machine 95 provided with the one wire storage tool 61 rotates the one wire storage tool 61 in an opposite direction to unwind and feed the wire rod 11 of such a length as to be wound on the other wire storage tool 61.

As just described, a part (e.g. half) of the wire rod 11 wound on the one wire storage tool 61 detached from the pair of flyers 31, 31 is rewound on the other wire storage tool 61. In this way, the pair of wire storage tools 61 on which the wire rod 11 having the necessary length is wound from the both sides are obtained.

It should be noted that the above spool rotating machines 95 and calibration machine 90 are an example of an apparatus for winding the wire rod 11 on the wire storage tools 61 and the apparatus for winding the wire rod 11 on the wire storage tools 61 is not limited to this example. In the wire storing step, any apparatus can be used as long as the wire rod 11 having the necessary length can be wound on the wire storage tools 61 detached from the pair of flyers 31, 31.

<Wire Storage Tool Mounting Step>

The wire storage tool mounting step is a step necessary when the above wire storing step is performed with the wire storage tools 61 detached from the pair of flyers 31, 31. In the wire storage tool mounting step, the pair of wire storage tools 61 having the wire rod 11 wound thereon from the both ends are mounted on the pair of flyers 31 of the winding apparatus 10.

As shown in FIG. 8, the coupling shaft 61*d* is provided in the wire storage tool 61 and the lock mechanism 64 is provided on the tip part of the mounting shaft 63 on the flyer 31. By inserting the coupling shaft 61*d* into the coupling hole 64*b* against the biasing force of the spring 64*d* in the lock mechanism 64, the wire storage tool 61 can be easily mounted on the flyer 31.

If the coupling shaft 61*d* is inserted into the coupling hole 64*b*, the lock member 64*c* is pressed against the annular groove 61*e* by the biasing force of the spring 64*d*. In this way, the coupling shaft 61*d* is prevented from coming out from the coupling hole 64*b*. Further, the lock mechanism 64 is so configured that the projection 61*k* enters the slit 64*e* with the coupling shaft 61*d* inserted in the coupling hole 64*b*. Thus, the wire storage tool 61 is unrotatably mounted on the mounting shaft 63.

<Winding Step>

In the winding step, a coil in which both a winding start end and a winding finish end are led out from an outermost peripheral layer is formed around the winding core 12 by rotating either one or both of the pair of flyers 31, 31 in synchronization or separately with the center axis of the winding core 12 as a center of rotation and winding the wire rod 11 fed from the wire storage tools 61 on the winding core 12.

In the winding apparatus 10 according to the present embodiment, the wire storage tool 61 for storing the wire rod 11 to be wound on the winding core 12 is provided on each of the pair of flyers 31. Thus, the relatively long wire rod 11 can be wound around the winding core 12 and a relatively large coil can be manufactured by causing the relatively long wire rod 11 to be stored on those wire storage tools 61 and rotating the pair of flyers 31 with respect to the winding core 12. Therefore, according to the present embodiment, it is possible to provide the winding apparatus 10 capable of manufacturing a large-size coil having a relatively large number of turns and the winding method using the same.

Figure 11:
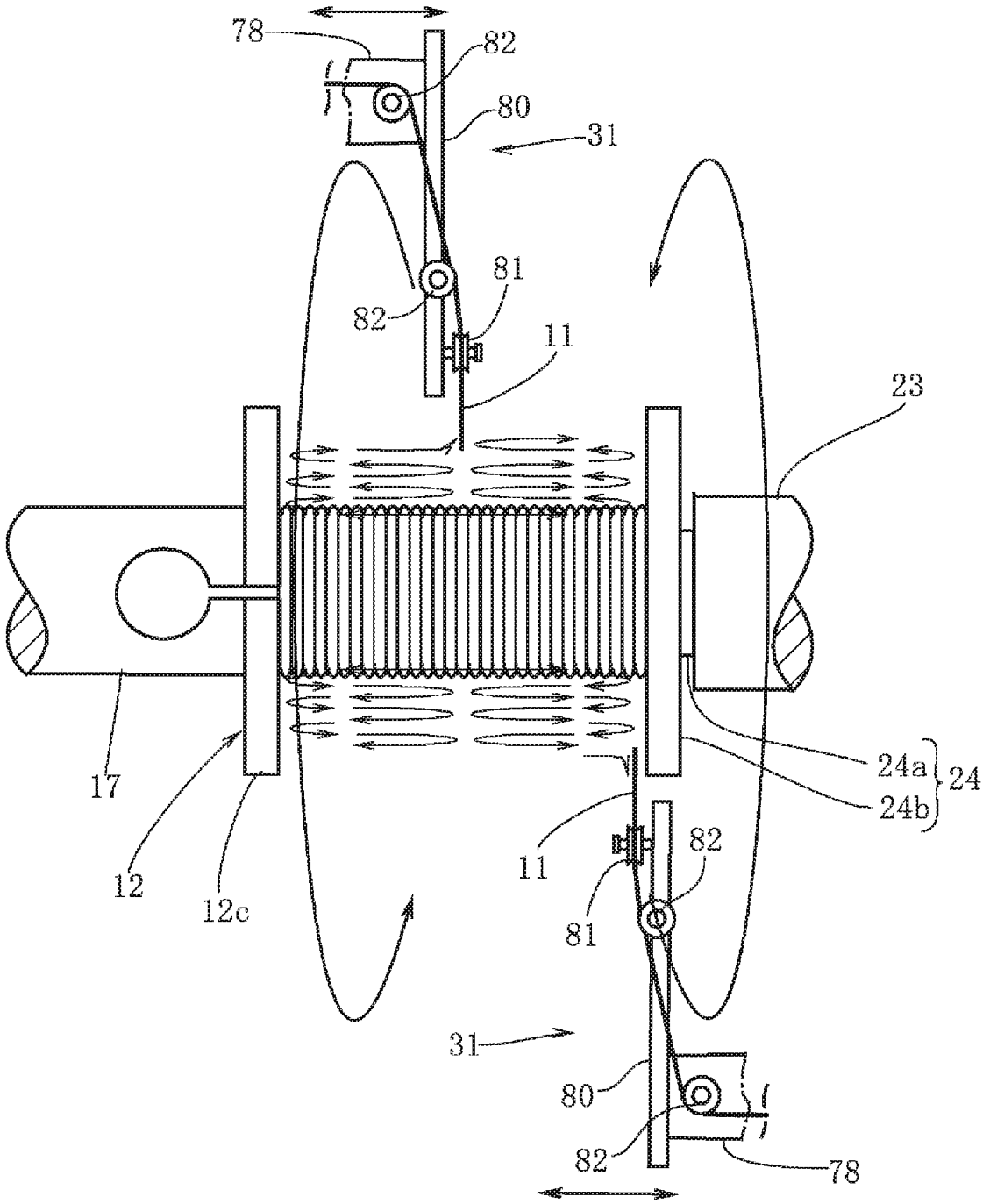
FIG. 11 is a conceptual diagram showing a state where sections of the wire rod fed from the both wire storage tools are simultaneously wound on a winding core by rotating a pair of the flyers in opposite directions.

Whether or not to rotate the winding core 12 and which one of the pair of flyers 31, 31 is to be rotated differ depending on the specifications of a coil desired to be obtained. For example, if the both flyers 31 are simultaneously rotated in opposite directions with the rotation axis of the winding core 12 as a center of rotation without rotating the winding core 12 as shown in FIG. 11, sections of the wire rod 11 are fed respectively from the wire storage tools 61 provided on the both flyers 31 and simultaneously wound on the winding core 12. At this time, if the pair of flyers 31, 31 are reciprocated in the axial direction of the winding core 12 by the traverse mechanism 41, the wire rod 11 can be aligned and wound over a plurality of layers on the winding core 12.

In this way, time required for winding can be shortened, and a coil in which both a winding start end and a winding finish end are led out from an outermost peripheral layer can be formed around the winding core 12 in a relatively short time as compared to the case where the entire wire rod 11 is wound on the winding core 12 by successively rotating only one flyer 31.

Figure 12A:
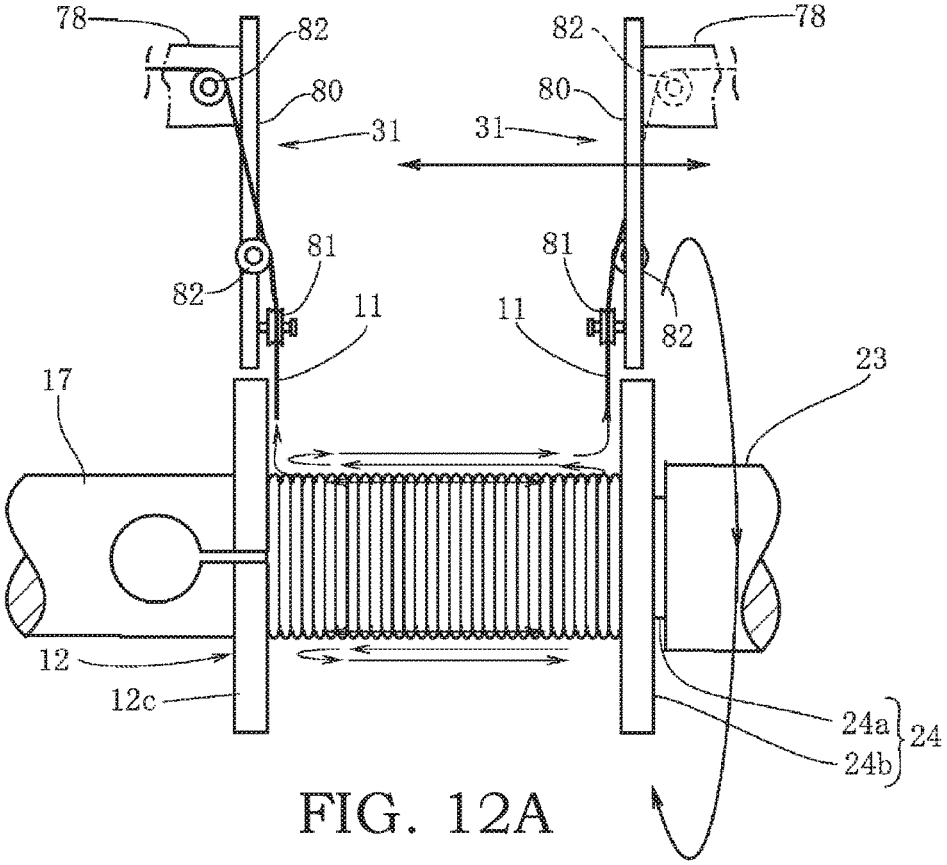
FIG. 12A is a conceptual diagram showing a state where the wire rod fed from the wire storage tool of one flyer is wound on the winding core.
Figure 12B:
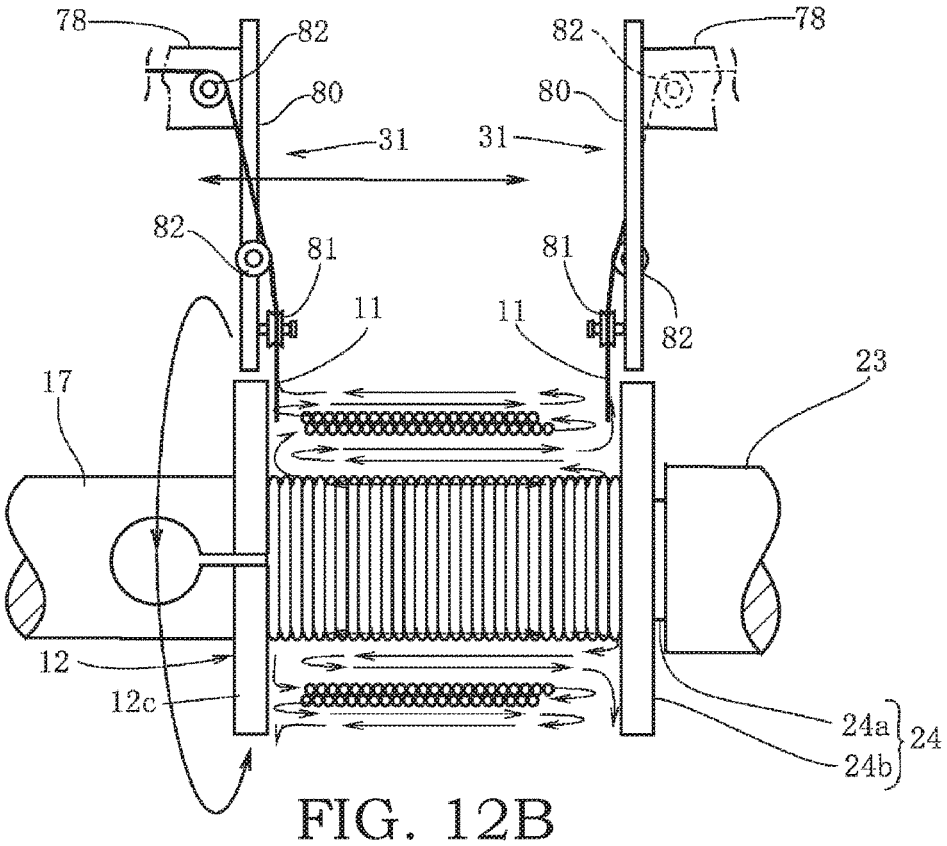
FIG. 12B is a conceptual diagram showing a state where the wire rod fed from the wire storage tool of the other flyer is wound on the winding core after the wire rod fed from the wire storage tool of the one flyer is wound on the winding core.

It should be noted that the wire rod 11 can also be wound on the winding core 12 by rotating the other flyer 31 after one flyer 31 is rotated instead of simultaneously rotating the both flyers 31 in the opposite directions. First, as shown in FIG. 12A, only the one flyer 31 is rotated with the axis of the winding core 12 as a center of rotation without rotating the winding core 12 and the other flyer 31. In this way, the wire rod 11 fed from the wire storage tool 61 provided on the one flyer 31 is wound on the winding core 12. After the wire rod 11 of the wire storage tool 61 on the one flyer 31 is wound on the winding core 12, the rotation of the one flyer 31 is stopped. Thereafter, as shown in FIG. 12B, the other flyer 31 is rotated with the axis of the winding core 12 as a center of rotation. In this way, the wire rod 11 fed from the wire storage tool 61 provided on the other flyer 31 is further wound on the already wound wire rod 11.

As just described, specifications for winding the wire rod 11 with respect to the winding core 12 can be diversified by making the pair of flyers 31 separately rotatable. Therefore, a plurality of types of coils in which both a winding start end and a winding finish end are led out from an outermost peripheral layer can be easily formed around the winding core 12.

Further, the above winding apparatus 10 includes the winding core servo motor 16 serving as the winding core rotation means for rotating the winding core 12 (FIG. 1).

Therefore, in the case of also rotating the winding core 12 in the same direction and at the same speed simultaneously with the rotation of the flyer 31, a relative positional relationship of the flyer 31 and the winding core 12 does not change.

In this case, the wire rod 11 is not wound on the winding core 12 from the wire storage tool 61 of the flyer 31 rotating together with the winding core 12, and the wire rod 11 fed from the wire storage tool 61 on the flyer 31 not rotating together with the winding core 12, e.g. the flyer 31 in a stopped state is wound on the rotating winding core 12.

Figure 13A:
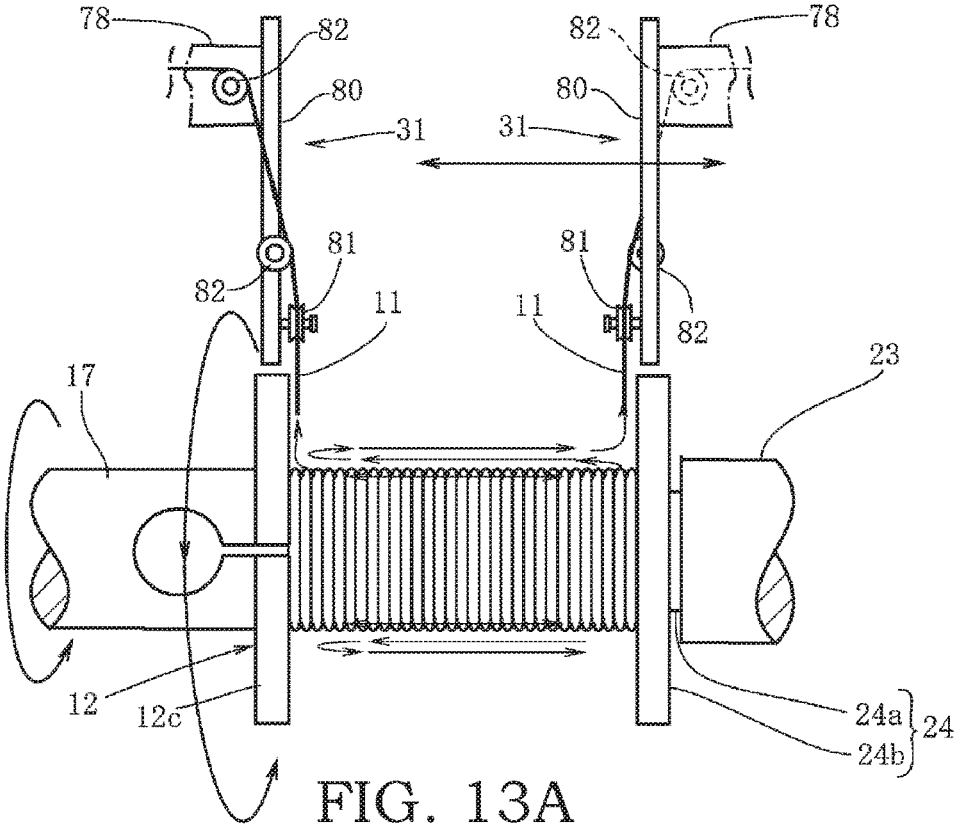
FIG. 13A is a conceptual diagram showing a state where the wire rod fed from the wire storage tool of the other flyer is wound on the winding core by simultaneously rotating the winding core and the one flyer.

In this winding method, the winding core 12 is first rotated by the winding core servo motor (winding core rotation means) 16 as shown in FIG. 13A, and one flyer 31 is rotated in the same direction and at the same speed as the rotation of the winding core 12 simultaneously with the rotation of the winding core 12. In this way, the wire rod 11 fed from the wire storage tool on the flyer 31 not rotating together with the winding core 12, e.g. the flyer 31 in the stopped state is wound on the rotating winding core 12.

Figure 13B:
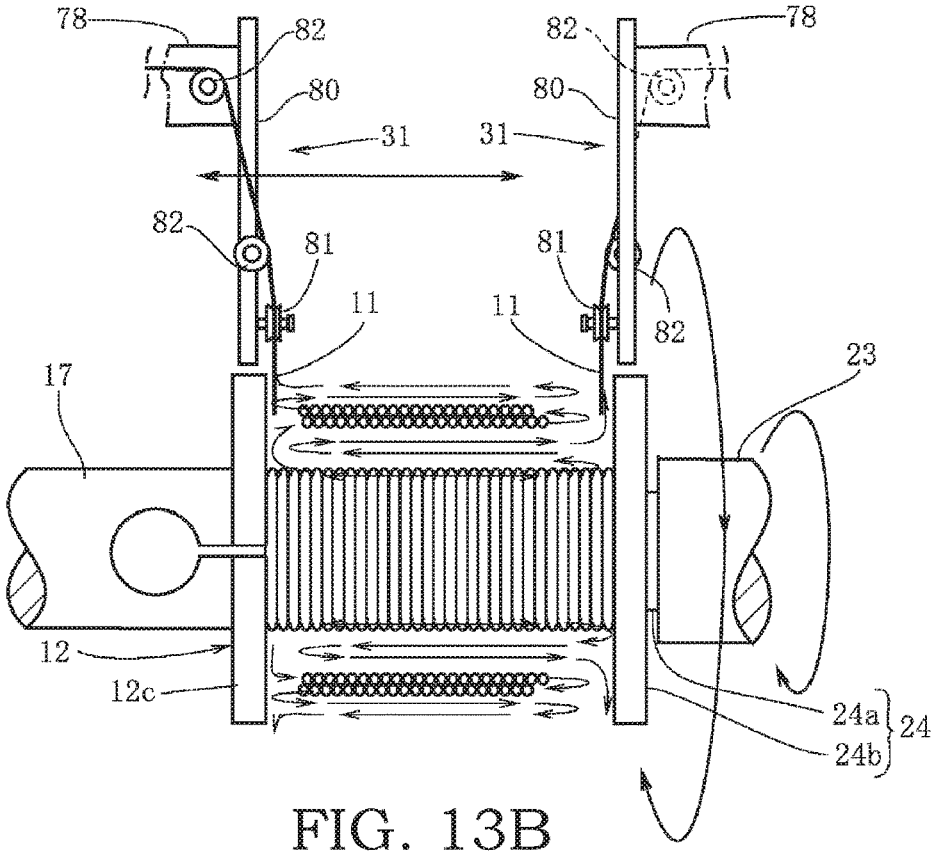
FIG. 13B is a conceptual diagram showing a state where the wire rod fed from the wire storage tool of the one flyer, the rotation of which is stopped, is wound on the winding core by rotating the other flyer together with the winding core after the wire rod fed from the wire storage tool of the other flyer is wound on the winding core by simultaneously rotating the winding core and the one flayer.

After the wire rod 11 of the wire storage tool 61 on the other flyer 31 is wound on the winding core 12, the rotation of the one flyer 31 is stopped. Thereafter, as shown in FIG. 13B, the other flyer 31 is rotated in the same direction and at the same speed as the rotation of the winding core 12. In this way, the wire rod 11 fed from the wire storage tool 61 provided on the other flyer 31 is further wound on the already wound wire rod 11.

As just described, a plurality of types of coils which has an arbitrary number of turns and an arbitrary number of layers and in which both a winding start end and a winding finish end are led out from an outermost peripheral layer can be easily formed around the winding core 12 by rotating the winding core 12 and separately rotating the pair of flyers 31. That is, specifications for winding the wire rod 11 with respect to the winding core 12 can be further diversified.

In the winding apparatus 10 according to the present embodiment, the tension device 71 is provided together with the wire storage tool 61 for each of the pair of flyers 31, 31. Thus, the wire rod 11 can be wound on the winding core 12 with a predetermined tension and winding unevenness due to different tensions in the winding operation of the wire rod 11 can be avoided.

Since the flyers 31 mounted with the wire storage tools 61 are rotated in the winding step as described above in the winding method according to the present embodiment, the wire storing step of storing the wire rod 11 on the wire storage tools 61 is performed before the winding step.

In the winding apparatus 10 according to the present embodiment, the wire storage tools 61 are detachably provided on the pair of flyers 31. Thus, if the wire storing step is performed using the wire storage tools 61 detached from the flyers 31 as shown in FIGS. 10A and 10B, the wire storage tool mounting step of mounting the wire storage tools 61 on the flyers 31 is performed thereafter and the winding step of winding the wire rod 11 fed from the wire storage tools 61 on the winding core 12 is performed even thereafter as shown in FIGS. 11 to 13B, the wire storing step using other wire storage tools 61 can be performed simultaneously with the winding step.

Thus, in the winding apparatus and the winding method according to the present embodiment, the winding step and the wire storing step can be simultaneously performed by preparing a plurality of the wire storage tools 61. Therefore, coils can be quickly manufactured as compared to a conventional technique requiring the wire storing step and the winding step to be successively performed without being able to simultaneously perform the wire storing step and the winding step.

It should be noted that although the wire rod 11 is directly wound on the winding core 12 to form a so-called air-core coil in the above embodiment, the present invention is not limited to this. An unillustrated bobbin may be fitted on the winding core 12 and a coil may be formed by winding the wire rod 11 on the bobbin.

Further, although the mechanism for detachably mounting the wire storage tool 61 on the flyer 31, 31 includes the coupling shaft 61*d* provided in the wire storage tool 61 and the lock mechanism 64 for mounting the coupling shaft 61*d* and the mounting shaft 63 having the lock mechanism 64 mounted thereon is pivotally supported on the flyer 31 in the above embodiment, the present invention is not limited to this. As long as the wire storage tool 61 can be detachably mounted on the flyer 31, 31, the wire storage tool 61 may be detachably mounted on the flyer 31, 31 by another mechanism such as screwing.

As described above, the winding apparatus 10 includes the winding core 12 on which the wire rod 11 is wound, the pair of flyers 31 arranged across the winding core 12 in the axial direction, the flyer rotation means (rotation servo motors 51) for rotating either one or both of the pair of flyers 31 with the axis of the winding core 12 as a center of rotation, the wire storage tools 61 respectively detachably mounted on the pair of flyers 31, the wire storage tools 61 storing the wire rod 11 to be wound on the winding core 12, and the tension devices 71 respectively provided on the pair of flyers 31, the tension devices 71 applying a tension to the wire rod 11 fed from the wire storage tool 61 and introduced to the winding core 12.

In this configuration, the wire storage tools 61 for storing the wire rod 11 to be wound on the winding core 12 are respectively provided on the pair of flyers 31. This enables the relatively long wire rod 11 to be wound around the winding core 12 and a large-size coil having a relatively large number of turns to be manufactured by causing the relatively long wire rod 11 to be stored on those wire storage tools 61 and rotating the pair of flyers 31 with respect to the winding core 12.

The winding apparatus 10 preferably includes the traverse mechanism 41 for moving either one or both of the pair of flyers 31 in the axial direction with respect to the winding core 12. Further, the winding apparatus 10 can also include the winding core rotation means (winding core servo motor 16) for rotating the winding core 12 about an axis thereof. In this case, preferably, the base end side of the winding core 12 is supported, and the supporting tool 21 for supporting the tip side of the winding core 12 is provided. By including the traverse mechanism 41 and the winding core rotation means (winding core servo motor 16), the wire rod 11 can also be aligned and wound and winding can be diversified.

The winding method using the above winding apparatus 10 includes the wire storing step of winding the wire rod 11 having a necessary length on the pair of wire storage tools 61 from both sides, the wire storage tool mounting step of mounting the pair of wire storage tools 61 having the wire rod 11 wound thereon from both ends on the pair of flyers 31 of the winding apparatus 10, and the winding step of winding the wire rod 11 fed from the wire storage tools 61 by rotating either one or both of the pair of flyers 31 with the axis of the winding core 12 as a center of rotation and forming a coil in which both a winding start end and a winding finish end are led out from an outermost peripheral layer around the winding core 12. Since the above winding apparatus 10 is used in this method, a large-size coil having a relatively large number of turns can be manufactured.

In the case of using the wire storage tools 61 capable of storing the relatively long wire rod 11, the wire storing step of storing the relatively long wire rod 11 on the wire storage tools 61 is performed before the winding step of actually winding the wire rod 11 on the winding core 12.

In the winding apparatus 10, the wire storage tools 61 are detachably provided on the pair of flyers 31. Thus, if the wire storing step is performed using the wire storage tools 61 detached from the flyers 31, the wire storage tool mounting step of mounting the wire storage tools 61 on the flyers 31 is performed thereafter and the winding step of winding the wire rod 11 fed from the wire storage tools 61 on the winding core 12 is performed even thereafter, the wire storing step using other wire storage tools 61 can be performed simultaneously with the winding step.

Thus, in the above winding apparatus 10 and winding method, coils can be quickly manufactured as compared to a conventional technique requiring the wire storing step and the winding step to be successively performed without being able to simultaneously perform the wire storing step and the winding step by preparing a plurality of the wire storage tools 61 and simultaneously performing the winding step and the wire storing step.

As described above, according to the above configuration, it is possible to provide the winding apparatus 10 capable of manufacturing a large-size coil having a relatively large number of turns and the winding method using the same. Further, even in the case of manufacturing the coil by winding the relatively long wire rod 11, it is possible to provide the winding apparatus 10 capable of quickly manufacturing a coil and the winding method using the same. That is, it is possible to provide the winding apparatus 10 capable of quickly manufacturing a large-size coil having a relatively large number of turns and the winding method using the same.

Embodiments of this invention were described above, but the above embodiments are merely examples of applications of this invention, and the technical scope of this invention is not limited to the specific constitutions of the above embodiments.

This application claims priority based on Japanese Patent Application No. 2018-119519 filed with the Japan Patent Office on Jun. 25, 2018, the entire contents of which are incorporated into this specification.

The invention claimed is:

1. A winding apparatus, comprising:

a winding core, a wire rod being wound on the winding core;

a pair of flyers arranged across the winding core in an axial direction;

flyer rotation means for rotating either one or both of the pair of flyers;

wire storage tools respectively detachably provided on the pair of flyers, the wire rod to be wound on the winding core being stored on the wire storage tools; and tension devices respectively provided on the pair of flyers, the tension devices applying a tension to the wire rod fed from the wire storage tools and introduced to the winding core.

2. The winding apparatus according to claim 1, comprising:

a traverse mechanism for moving either one or both of the pair of flyers in the axial direction with respect to the winding core.

3. The winding apparatus according to claim 1, comprising:

winding core rotation means for rotating the winding core about an axis thereof.

4. The winding apparatus according to claim 3, wherein:

a base end side of the winding core is supported, and a supporting tool is provided to support a tip side of the winding core.

5. A winding method using the winding apparatus according to claim 1, comprising:

a wire storing step of winding a wire rod having a necessary length on a pair of the wire storage tools from both sides;

a wire storage tool mounting step of mounting the pair of wire storage tools having the wire rod wound thereon from both ends on the pair of flyers of the winding apparatus; and a winding step of winding the wire rod fed from the wire storage tools on the winding core by rotating either one or both of the pair of flyers about an axis of the winding core as a center of rotation and forming a coil around the winding core, both a winding start end and a winding finish end being led out from an outermost peripheral layer.

* * * * *